US005167181A

United States Patent [19]

Ken Lee

[11] Patent Number: 5,167,181

[45] Date of Patent: Dec. 1, 1992

[54] FLUID TRANSFER DEVICES

[76] Inventor: W. Ken Lee, 1712 Daisy Ct., St. Paul, Minn. 55112

[21] Appl. No.: 802,285

[22] Filed: Dec. 4, 1991

[51] Int. Cl.[5] ..... F04B 27/00

[52] U.S. Cl. ..... 91/499; 417/269; 417/500; 92/71

[58] Field of Search ..... 417/269, 500; 91/476, 91/499; 92/71

[56] References Cited

U.S. PATENT DOCUMENTS

| | | | |
|---|---|---|---|
| 1,064,562 | 6/1913 | Summerill | 60/494 |
| 1,697,853 | 1/1929 | Coursen | 417/269 |
| 2,000,265 | 5/1935 | Vickers | 92/86 |
| 2.417,137 | 3/1947 | Smith | 417/500 X |
| 2,436,492 | 2/1948 | Shepard | 417/500 |
| 3,018,737 | 1/1962 | Cook te al. | 417/269 X |
| 3,079,870 | 3/1963 | Yhoma | 92/86.5 |
| 3,209,701 | 10/1965 | Phinney | 92/86.5 |
| 3,373,696 | 3/1968 | Geyer | 91/499 |
| 3,943,717 | 3/1976 | Schexnayder | 60/455 |
| 4,776,260 | 10/1988 | Vincze | 417/269 X |

FOREIGN PATENT DOCUMENTS

| | | | |
|---|---|---|---|
| 550753 | 12/1933 | Fed. Rep. of Germany | 417/500 |
| 294567 | 12/1990 | Japan | 417/269 |

*Primary Examiner*—Leonard E. Smith
*Attorney, Agent, or Firm*—Richard C. Litman

[57] ABSTRACT

A positive displacement fluid transfer device is disclosed which may be operated either as a fluid pump, compressor or motor with no modification. The device is based mechanically upon axial cylinder and plunger hydraulic devices using a swash plate to reciprocate the plunger or plungers, but further includes a gear train to cause the plunger or plungers to simultaneously rotate as they reciprocate within the cylinders. Reliefs in the sides of the plungers periodically rotate into alignment with inlet and outlet ports to provide a fluid flow path. One manifold of the device is wholly contained within the bounds of the other, thus providing a compact system with a relatively direct fluid flow path; a special case provides for concentric inlet and outlet minifolds. Other improvements are provided, such as an internal pressure relief bypass between the inlet and outlet manifolds and utility passages which provide for cooling, lubrication and fluid leakage control past the plungers. The direction of rotation of the device is easily reversible either by reversing the inlet and outlet flow or by revising the positions of the plunger gears relative to the central gear.

13 Claims, 2 Drawing Sheets

FIG. 3
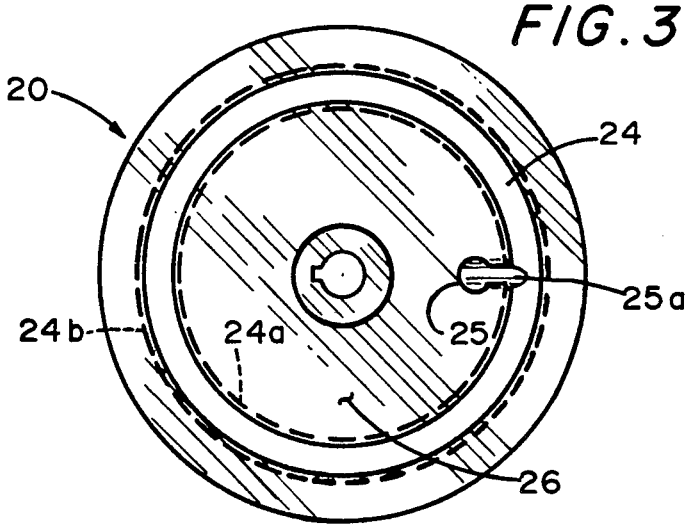
FIG. 4
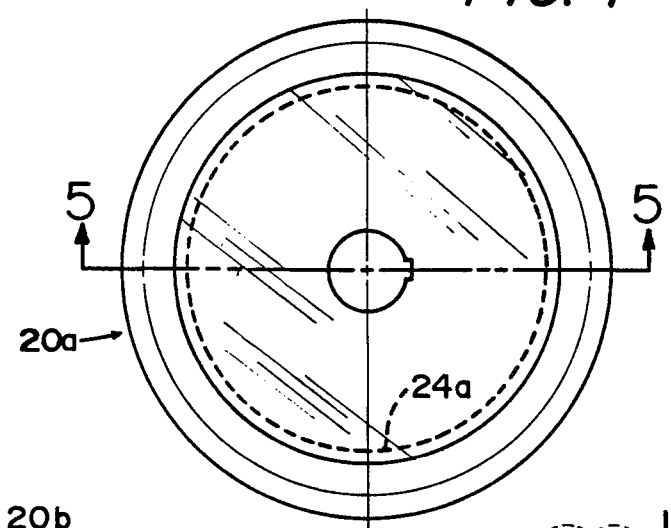
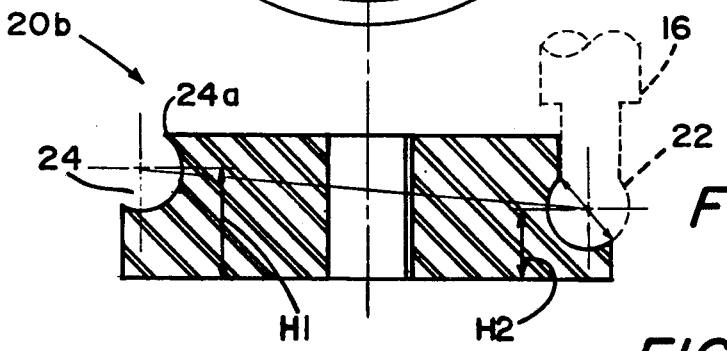
FIG. 5A
FIG. 5B
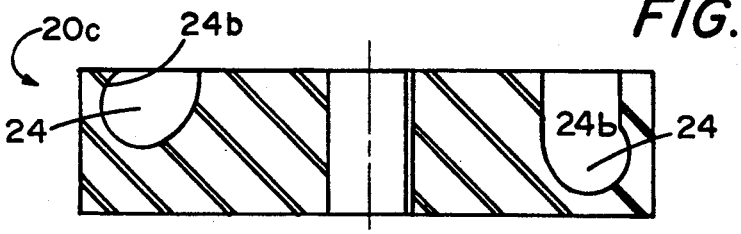

FLUID TRANSFER DEVICES

FIELD OF THE INVENTION

This invention relates generally to positive displacement devices, such as motors or pumps and compressors powered by prime movers such as electric motors, engines, and turbines, and using hydraulic or other fluids, and more specifically to such a device including inlet and outlet plenums or manifolds one of which is contained wholly within the boundaries of the other, as well as other improvements.

BACKGROUND OF THE INVENTION

The use of hydraulic or other fluid for the transfer of energy from one point to another in a system has been developed to a great extent. It has been found that the principle of plural piston or plunger devices, in which the plungers cooperate with a wobble or swash plate, provides for relatively high efficiency in such devices. Typically, however, the valving incorporated with such devices comprises either a rotary valve adjacent the ends of the plunger cylinders opposite the swash plate, or poppet valves and their accompanying relative complexity.

Such valving has generally been required heretofore, due to the lack of a mechanism providing for fluid transfer directly from the sides of the cylinders. While ported or apertured plungers have been known, the means to provide the precise rotation of the plungers in order to eliminate the need for other types of valve mechanisms has been lacking in the art with the exception of one patent to be discussed below. Moreover, the various related devices fail to take advantage of the gains to be made by more efficient inlet and outlet passages, as well as other improvements.

The need arises for a fluid transfer device which includes inlet and outlet manifolds one of which is contained wholly within the boundaries of the other, and which may take advantage of the efficiencies thus provided. Such a device should also provide for other improvements in the field, such as mechanical means providing for the simultaneous rotation and reciprocation of the plungers and the resulting simplification of the valve mechanism; an integral pressure relief or bypass means; and an integral and simplified means providing for lubrication, cooling and leakage control from the cylinders and plungers.

DESCRIPTION OF THE RELATED ART

W. L. Coursen U.S. Pat. No. 1,697,853 discloses a Multicylinder Pump which provides for the simultaneous reciprocation and rotation of the plural plungers of the pump. While the gear train and plunger reliefs providing valve means to the cylinder side passages are generally similar to the present invention, the Coursen device includes a relatively complex method of positively reciprocating the plungers by means of opposed swash plates. Moreover, the passage of the operating fluid through the device is relatively complex, including the two opposed swash plate ends and the gear train. The complex fluid passage, while providing lubrication to those areas, results in some loss in the efficiency of the device and cannot transfer corrosive and/or aggressive fluids.

J. U. Thoma U.S. Pat. No. 3,079,870 discloses Axial Piston Hydraulic Units. The device discloses a plurality of parallel cylinder bores with pistons or plungers, which pistons or plungers cooperate with a swash or wobble plate at one end of the cylinders. No means is provided for the specific rotation of the pistons, as they cooperate with the swash plate by means of spherical joints. The valve means is located at the ends of the cylinders opposite the swash plate and comprises a rotary valve. Lubrication passages are provided from the cylinders to the central shaft; these passages do not perform the same function as those provided in the present invention.

D. D. Phinney U.S. Pat. No. 3,209,701 discloses a Pump generally of the axial plunger and swashplate type. The device is primarily intended for the transfer of fluids (such as hydrazine) which do not also serve as the lubricating fluid for the pump, and thus a relatively complex sealing system is provided. Valving is accomplished by means of a relatively complex piston or plunger arrangement, and an internal bypass valve is provided between the inlet and outlet passages of the pump. The fluid inlet and outlet passages are not concentric.

None of the above noted patents, either singly or in combination, are seen to disclose the specific arrangement of concepts disclosed by the present invention.

SUMMARY OF THE INVENTION

By the present invention, an improved fluid transfer device is disclosed.

Accordingly, one of the objects of the present invention is to provide an improved fluid transfer device which provides inlet and outlet plenums or manifolds, one of which is contained wholly within the boundaries of the other, for greater efficiency.

Another of the objects of the present invention is to provide an improved fluid transfer device which may be operated as either a pump, motor or compressor.

Yet another of the objects of the present invention is to provide an improved fluid transfer device which may be used with a variety of fluids, either liquid or gas.

Still another of the objects of the present invention is to provide an improved fluid transfer device which provides for the precise rotation and simultaneous reciprocation of the plunger or plungers incorporated therein.

A further object of the present invention is to provide an improved fluid transfer device which eliminates a need for additional components for valve means.

An additional object of the present invention is to provide an improved fluid transfer device which may include pressure relief means located directly between the inlet and outlet manifolds for greater efficiency.

Another object of the present invention is to provide an improved fluid transfer device which incorporates utility passages directly between the cylinder or cylinders and the inlet manifold.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 3 is an offset partial cross sectional view taken along line 3—3 of FIG. 2, showing view of the face of swash plate 20 and the detail of the plunger fitting retaining race.

FIG. 4 is an alternative swash plate construction.

FIG. 5A is a cross section through line 5—5 of FIG. 4.

FIG. 5B is a similar cross section of an alternative swash plate construction.

Similar reference characters designate corresponding parts throughout the several figures of the drawings.

DESCRIPTION OF THE PREFERRED EMBODIMENT

Figure 1:
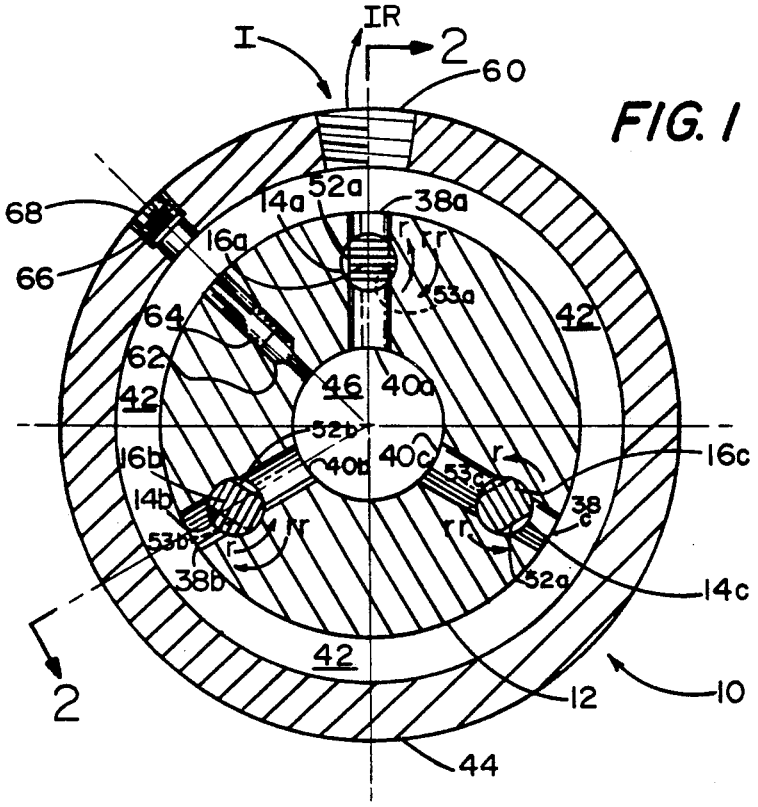
FIG. 1 is a cross sectional view of the present invention taken along line 1—1 of FIG. 2.
Figure 2:
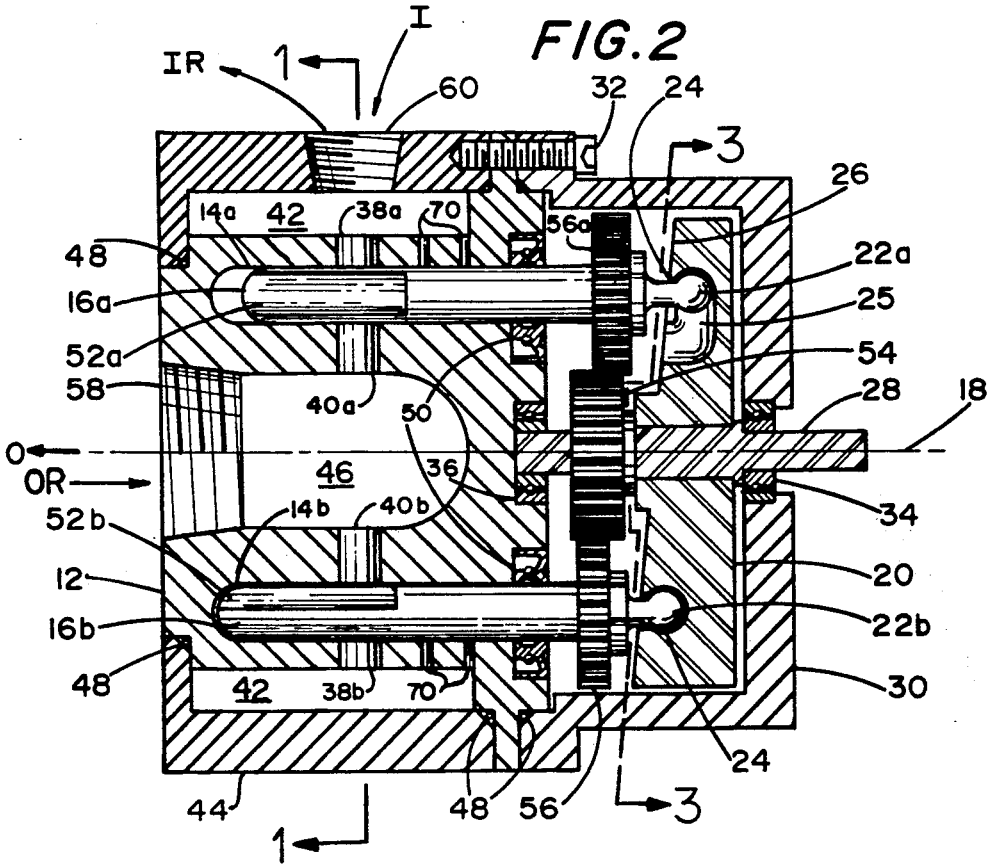
FIG. 2 is an offset partial cross sectional view taken along line 2—2 of FIG. 1.

Referring now to the drawings, particularly FIG. 2 of the drawings, the present invention will be seen to relate to a positive displacement fluid transfer device 10 having inlet and outlet manifolds or plenums, one of which is contained wholly within the boundaries of the other, and incorporating other improvements. (It will be noted in FIG. 2 that outlet manifold 46 is contained entirely within cylinder block 12, which cylinder block 12 is completely surrounded by inlet manifold 42. It will be understood that the flow of fluid may be reversed through device 10 as desired or required, and that manifolds 42 and 46 may consequently have their respective inlet and outlet functions reversed. In either case, manifold 46 is contained entirely within the boundaries of manifold 42. While manifold 46 may be concentric within manifold 42, as shown in FIG. 1, it will be realized that this is a special case and that other arrangements are possible.)

Device 10 will be seen to have a cylinder block 12 which includes one or more cylinders 14. (FIG. 1 will be seen to disclose three cylinders 14*a*, 14*b*, and 14*c*. However, it will be apparent to those skilled in the art that from one to any practicable number of cylinders 14 and associated plungers 16 may be incorporated in combination with the present invention.) An equal number of plungers or pistons 16, in the drawings designated as 16*a*, 16*b*, and 16*c*, rotate and reciprocate in the corresponding cylinders 14*a*, 14*b* and 14*c* as will be explained further below. Cylinders 14*a*, 14*b* and 14*c* will be seen to be disposed axially and parallel to central axis 18 in a concentric annular array; this arrangement may be more clearly seen in FIG. 1.

Plungers 16*a*, 16*b* and 16*c* provide for variation in the volume of their respective cylinders 14*a*, 14*b* and 14*c* by means of a reciprocating action provided by a wobble or swash plate 20. Plungers 16*a*, 16*b* and 16*c* are provided with spherical fittings 22*a*, 22*b* and 22*c* (22*c* is not shown in the sectioned views) which cooperate with a concentric race 24 formed in the inclined surface 26 of swash plate 20.

Swash plate 20 and race 24 may be seen more clearly in FIG. 3. Race 24 will be seen to comprise a circular cross section (see FIG. 2) which is somewhat narrower at the inclined surface 26 of swash plate 20 and which closely conforms to the circular sectional shape of plunger fittings 22*a*, 22*b*, and 22*c*. The resulting inner lip 24*a* and outer lip 24*b* serve to retain fittings 22*a*, *b* and *c* within race 24. Plunger fittings 22*a*, *b* and *c* may be installed within race 24 by means of installation port 25, which port 25 provides a generally hemispherical passage of equal diameter to that of spherical plunger fittings 22*a*, *b* and *c*. Plunger fitting installation port 25 is located immediately within concentric race 24, and cooperates with race 24 by means of an installation channel 25*a*.

From the foregoing, it will be seen that once the spherical fittings 22*a*, *b* and *c* respectively of plungers 16*a*, *b* and *c* are inserted within installation port 25 and transferred to race 24 by means of installation channel 25*a*, inner and outer lips 24*a* and 24*b* will serve to retain spherical fittings 22*a*, *b* and *c* within race 24 and thus cause a cooperating action between plunger 16*a*, *b* and *c* and race 24. Fittings 22*a*, *b* and *c* cannot escape inwardly to installation port 25 via installation channel 25*a*, due to the fixed axes of plungers 16*a*, *b* and *c* within their respective cylinders 14*a*, *b* and *c* once plungers 16*a*, *b* and *c* have been installed.

Alternative means of forming a swash plate and retaining sperical fittings within a race in the swash plate are shown in FIGS. 4, 5A, and 5B. In FIG. 4, swash plate 20*a* will be seen to provide only a single inner lip 24*a* for the retention of a plunger spherical fittings 22. No outer lip is required, as the parallel cylinder bores 14 preclude outward or inward lateral movement of plungers relative to swash plate race 24. Therefore a single retaining lip, either inner lip 24*a* as shown in FIGS. 4 and 5A, or outer lip 24*b* as shown in FIG. 5B, is sufficient to retain plunger spherical fittings 22 within race 24. It will also be noted that the swash plate construction of FIG. 4, 5A and 5B providing only a single retaining lip 24*a* or 24*b* further allows the installation of spherical fittings 22 within race 24 without the requirement for a specific installation port 25 and channel 25*a*. Spherical fittings 22 may be temporarily held in place within race 24 while plungers 16 are installed within cylinders 14, which cylinders 14 will then serve to retain the assembly as discussed above. While the double retaining lip 24*a* and 24*b* of swash plate 20 may be preferred from a structural standpoint, the simplified construction of swash plates 20*b* and 20*c* of FIGS. 5A and 5B may be more desirable in some cases.

Swash plate 20 includes an inclined face 26, as described above. Alternatively, a swash plate may be constructed having a face normal to central axis 18, as is the case with swash plates 20*a* and 20*b* of FIGS. 5*a* and 5*b*. In any case, the race 24 will be inclined relative to central axis 18, in order to provide reciprocating action for plungers 16. As spherical fittings 22 do not ride upon the face 26 of swash plate 20, 20*a*, or 20*b*, the face 26 may be normal or at any angle to axis 18, so long as race 24 is inclined, as shown by the differing heights H1 and H2 of FIG. 5A.

Swash plate 20, 20*a*, 20*b* or 20*c* may be keyed or otherwise secured to rotary shaft 28. Rotary shaft 28 is retained within device 10 by an upper cap 30, which cap 30 is secured to cylinder block 12 and outer case 44 by cap screws 32 (one of which is shown in FIG. 2) or other suitable means. Rotary shaft 28 revolves in upper bearing 34 located in upper cap 30 and lower bearing 36 located in the top of cylinder block 12.

As shaft 28 and swash plate 20, 20*a*, 20*b* or 20*c* rotate, spherical fittings 22*a*, 22*b* and 22*c* ride in swash plate race 24 to operate plungers 16*a*, 16*b* and 16*c* within their respective cylinders 14*a*, 14*b* and 14*c*. It will be seen that as the inclined race 24 of swash plate 20, 20*a*, 20*b* or 20*c* rotates, plungers 16*a*, 16*b* and 16*c* will reciprocate within their respective cylinders 14*a*, 14*b* and 14*c*, thus causing the volume of each cylinder 14*a*, 14*b* or 14*c* to change as shaft 28 rotates.

As no valve means is provided at the ends of cylinders 14*a*, 14*b* and 14*c*, other means must be provided for the passage of fluid through the cylinders 14*a*, 14*b* and 14*c*. Device 10 accomplishes this by means of radial inlet ports 38*a*, 38*b* and 38*c* to each respective cylinder 14*a*, 14*b* and 14*c*, and corresponding radial outlet ports 40*a*, 40*b*, and 40*c* from each respective cylinder. (It will be obvious to those knowledgeable in the art that the flow through inlet ports 38*a*, *b* and *c* and outlet ports 40*a*, *b* and *c* may easily be reversed in the present invention. However, the terms "inlet" and "outlet" will be used consistently throughout the specification for greater clarity.)

Inlet ports 38*a*, *b* and *c* are supplied by an annular inlet manifold or plenum 42 which is formed around cylinder block 12. An outer case 44 is provided around cylinder block 12 which includes the annular space comprising inlet manifold 42. Outlet ports 40*a*, *b* and *c* pass inwardly from the respective cylinders 14*a*, *b* and *c* to enter a central outlet manifold 46. The assembly of cylinder block 12, upper cap 30 and outer case 44 may be sealed by means of O rings 48 or other appropriate means, while plunger seals 50*a*, 50*b* and 50*c* at the respective upper ends of cylinders 14*a*, *b* and *c* provide further sealing of cylinders 16*a*, *b* and *c* relative to the space provided within upper cap 30. As no transfer of fluid is provided between cylinders 14*a*, *b* and *c* and the space contained within upper cap 30, a separate lubricating fluid (grease, oil, etc.) may be provided for the lubrication of plunger fittings 22*a*, *b* and *c* within race 24, as well as central gear 54 and plunger gears 56*a*, *b* and *c* described further below.

Passage for fluid through cylinders 14*a*, *b* and *c* is provided by means of flattened reliefs 52*a*, 52*b* and 52*c* in the sides of their respective plungers 16*a*, *b* and *c*. As plungers 16*a*, *b* and *c* are rotated in their respective cylinders 14*a*, *b* and *c*, the respective reliefs 52*a*, *b* and *c* will alternately pass by the respective inlet ports 38*a*, *b* and *c* and outlet ports 40*a*, *b* and *c*, thus allowing fluid to pass into and out of cylinders 14*a*, *b* and *c*.

The means for precisely rotating plungers 16*a*, *b* and *c* in concert with the reciprocation described above is by a gear train contained within upper cap 30 and shown in FIG. 2. A central gear 54 is affixed to rotary shaft 28 and turns with rotary shaft 28. Three plunger gears 56*a*, 56*b* and 56*c* are affixed respectively to the ends of plungers 16*a*, 16*b* and 16*c* adjacent their respective spherical fittings 22*a*, *b* and *c* and mesh with central gear 54. All gears 54, 56*a*, 56*b* and 56*c* have straight cut teeth rather than helical or other variation, for reasons which will be explained further below. As rotary shaft 28, swash plate 20 and central gear 54 rotate relative to cylinder block 12 and upper cap 30, plunger gears 56*a*, *b* and *c* will also be caused to rotate due to their meshing engagement with central gear 54. As plunger gears 56*a*, *b* and *c* are affixed respectively to plungers 16*a*, *b* and *c*, plungers 16*a*, *b* and *c* will also rotate to provide alternate opening of respective inlet ports 38*a*, *b* and *c* and outlet ports 40*a*, *b* and *c* by means of the rotation of the respective reliefs 52*a*, *b* and *c* in the sides of plungers 16*a*, *b* and *c*.

A fluid transfer device 10 incorporating the general structure described above may be operated either as a pump, compressor or motor. In order to more fully understand the operation and flow through device 10, it will initially be assumed that device 10 will be operated as a pump or compressor, by supplying power to rotary shaft 28. In order for those components described as "inlet" or "outlet" above to properly function as such, shaft 28 must be turned in a clockwise direction when device 10 is viewed from the right side, or shaft 28 end, of FIG. 2 in the embodiment illustrated.

As shaft 28, and thus swash plate 20 and central gear 54, are rotated clockwise, simultaneous reciprocation and rotation of each of the plungers 16*a*, *b* and *c* will occur within their respective cylinders 14*a*, *b* and *c*. Plunger 16*a* will be seen to have relief 52*a* turned 90 degrees to the axis of inlet and outlet ports 38*a* and 40*a*, thus causing the major diameter of plunger 16*a* to block any flow to or from inlet and/or outlet ports 38*a* and 40*a* and into or out of cylinder 14*a*, as shown in FIG. 1. At the same instant, plunger 16*a* will be at or very near the top of its stroke as shown in FIG. 2, providing the maximum available fluid volume within cylinder 14*a*.

As shaft 28 continues to rotate clockwise, swash plate 20 will also be rotated to cause plunger 16*a* to move downward within cylinder 14*a*, thereby reducing the available fluid volume within cylinder 14*a*. At the same time, the meshing engagement of plunger gear 56*a* with central gear 54 will cause plunger 16*a* to rotate counterclockwise, as shown by directional indicators r, thus causing relief 52*a* to rotate toward radial outlet port 40*a*. Thus, any fluid contained within the volume of cylinder 14*a* will be forced along the side of plunger 16*a* by means of relief 52*a*, and outward through outlet port 40*a* into central outlet manifold 46 and ultimately outward from manifold outlet 58 as designated by outlet flow path O. The straight cut teeth of central gear 54 and plunger gears 56*a*, *b* and *c* permit plunger gears 56*a*, *b* and *c* to reciprocate axially relative to central gear 54 as plungers 16*a*, *b* and *c* are reciprocated by swash plate 20, without affecting the timing of the rotation of plungers 16*a*, *b* and *c*.

It will be understood that cylinder block 12 and cylinders 14*a*, *b* and *c*, upper cap 30, and outer case 44 do not rotate relative to rotary shaft 28, swash plate 20 and central gear 54. However, in the accompanying drawing figures the above described action of plunger 16*a* will cause it to reciprocate and rotate within cylinder 14*a*, to a position essentially the same as plunger 16*b* as shown in FIGS. 1 and 2. To continue the discussion, the action of plunger 16*b* will be described as it is actuated within its cylinder 14*b* to achieve a position similar to that shown in the case of plunger 16*c* in FIG. 1 of the drawings.

As plunger 16*b* continues to rotate counterclockwise, as shown by indicators r, relief 52*b* will be rotated to a position 90 degrees to inlet and outlet ports 38*b* and 40*b*, thus causing plunger 16*b* to block any flow to or from those ports 38*b* and 40*b*. At this point, a plunger 16*b* would be at or very near the maximum extension into cylinder 14*b*, essentially as shown in cylinder 14*b* of FIG. 2. As rotary shaft 28 and central gear 54 continue to rotate each of the plunger gears 56*a*, *b* and *c* counterclockwise, the relief 52*b* in the side of plunger 16*b* will be turned toward inlet port 38*b*, in a manner like that shown at the position of cylinder 14*c* in FIG. 1. Simultaneously with the above described rotation, plunger 16*b* will be withdrawn from cylinder 14*b*, thus increasing the volume available for fluid within cylinder 14*b* and drawing fluid from inlet port 38*b* along the side of relief 52*b* and into cylinder 14*b*. As inlet port 38*b* cooperates with inlet manifold 42, fluid will be drawn from inlet manifold 42, which ultimately receives its fluid input from inlet 60, as indicated by inlet flow arrow I.

The above described cycle may be applied equally to such a device having only a single cylinder 14 and plunger 16, or to such a device providing a plurality of such cylinders 14 and plungers 16. As such cylinders 14 and plungers 16 must be offset from the central axis of the device, no more space is required to provide a plurality of such cylinders 14 and plungers 16 surrounding a central axis in an annular and concentric array. Some advantages in operation are gained by the provision of plural cylinders 14 and plungers 16, as the pressure pulses of fluid caused by the action of such plungers 16 reciprocating within cylinders 14 will be smoothed or averaged out with a greater number of cylinders 14 and plungers 16.

The above description of the operation of device 10 will be seen to apply equally to a compressor, as pressure is built up by the action of plungers 16 within cylinders 14 to reduce the available volume within cylinders 14. Thus, device 10 may be used with essentially equal facility as either a volumetric pump or as a compressor. It will also be appreciated that by merely reversing the direction of rotation of device 10, the inlet and outlet flows may be reversed. Alternatively, if the reversal of rotational direction is not practicable, the rotational alignment of plunger gears 56, and thereby plungers 16, may be adjusted to cause reliefs 52 to cooperate with ports 38 and 40 at different points in the reciprocal cycle caused by swash plate 20 in order to reverse the fluid directional flow. By turning each plunger gear 56*a, b* and *c* and the respective attached plungers 16*a, b* and *c* 180 degrees relative to central gear 54 and swash plate 20, such flow reversal may be accomplished using the same rotation as described above.

The new positions of the plungers 16*a, b* and *c* to produce the reversal of rotation or flow reversal with the same rotation, are indicated by reliefs 53*a*, 53*b* and 53*c* shown in broken lines in FIG. 1. This 180 degree repositioning of plungers 16*a, b* and *c* will result in a reversal of rotation of plungers 16*a, b* and *c*, indicated by rotation reversal arrows rr, and a resultant reversal of rotation of cooperating rotational components assuming the direction of fluid flow remains the same. Alternatively, with this 180 degree repositioning of plungers 16*a, b* and *c*, the same rotational direction will result in a reversal of the direction of fluid flow through device 10 as indicated by inlet reversal IR (FIGS. 1 and 2) and outlet reversal OR (FIG. 2).

It will be apparent to those knowledgeable in the art, that any such fluid transfer device 10 will produce a higher fluid pressure at the outlet manifold port 58, due to work resistance in the fluid circuit downstream, than will exist at the inlet manifold port 60. Depending upon the circumstances, the pressure differential may be sufficiently large so as to cause seals to blow out, or even greater damage such as shearing of the rotary shaft. In order to preclude such difficulties, such fluid transfer devices incorporate a pressure relief or bypass valve at some point in the system. Device 10 provides for such a device by means of radial pressure relief passage 62 extending between the annular inlet mainfold 42 and central outlet mainfold 46. Passage 62 provides for a pressure relief or bypass valve 64, which operates to prevent too great a pressure differential buildup between outlet manifold 46 and inlet manifold 42. If pressure does build to a higher differential than that for which relief valve 64 has been set, relief valve 64 will open and permit a flow of fluid directly from the outlet manifold 46 to the inlet manifold 42 to allow the reduction of the pressure differential. The direct passage provided by radial relief passage 62 permits relatively rapid reaction to such pressure differentials as may occur in device 10 in operation.

Generally it will be necessary to adjust or possibly replace relief valve 64 from time to time. For example, if the inlet flow I and outlet flow O are reversed as discussed above, it will likely be necessary to reverse relief valve 64 within passage 62 for proper operation. An access port 66 is provided in the side of outer case 44, immediately outward from radial relief passage 62. By positioning the pressure relief valve access port 66 in such a manner, pressure relief valve 64 may be easily accessed for adjustment or replacement as required, without the need to remove the outer case 44 from device 10. An access port plug 68 is used to seal access port 66.

It will be understood that fluid transfer device such as device 10 commonly produce relatively high pressures, which results in relatively high loads between plungers 16 and cylinders 14. These high loads can be detrimental to various components and clearances within device 10 due to the heat generated by any friction between plungers 16 and the walls of cylinders 14. Moreover, the relatively close clearances, particularly between the walls of cylinders 14*a, b* and *c* and plungers 16*a, b* and *c*, require some lubrication.

Device 10 provides for each of the above requirements by means of utility passages 70, which provide a limited fluid path from cylinders 14*a, b* and *c* below inlet ports 38*a, b* and *c*, to annular inlet manifold 42. One or more utility passages 70 may be incorporated for each cylinder 14. Utility passages 70 provide for each of the above requirements by (1) allowing relatively high pressure fluid which has been forced by the sides of plungers 16*a, b* and *c* to flow back to the relatively low pressure of the inlet manifold 42, thus relieving the pressure applied to seals 50, (2) allowing the inlet manifold 42 fluid to carry away at least a portion of the inlet buildup from the frictional forces created between plungers 16 and the walls of cylinders 14, and (3) allowing some limited flow of fluid along the sides of cylinders 14 in order to provide some lubrication between the walls of cylinders 14 ahnd plungers 16.

As noted above, device 10 may also be used as a motor by applying a relatively high pressure fluid to inlet manifold port 60 and allowing the work performed by the fluid as it passes through device 10 to outlet manifold port 58 to cause a torque to be produced to rotary shaft 28. Such hydraulic of fluid motors which utilize other principles or combinations of features are known, and they often may be used either as pumps or motors with little modification, depending upon the exact structure of the apparatus. In the case of device 10, as relatively high pressure fluid is applied at inlet manifold port 60 and thus into inlet manifold 42 and inlet ports 38*a, b* and *c*, fluid will be able to pass into only a single cylinder 14*c* (in the configuration shown in FIG. 1) due to the position of reliefs 52*a, b* and *c* of respective plungers 16*a, b* and *c*. It will be seen in FIG. 1 that only relief 52*c* is oriented toward an inlet port 38*c*, while relief 52*b* is oriented toward an outlet port 40*b* and relief 52*a* is positioned 90 degrees to both inlet port 38*a* and outlet port 40*a*, thus causing the major diameter of plunger 16*a* to block both inlet port 38*a* and outlet port 40*a*.

The position of plunger 16*c* at this point will be seen to be 120 degrees from the top of its stroke, due to the rotation of the inclined race 24 of swash plate 20, 20*a*, 20*b* or 20*c*. As fluid is forced past relief 52*c* of plunger 16c and into cylinder 14c, the fluid pressure will cause plunger 16c to be forced outward in cylinder 14c, which will apply a load to swash plate 20, 20a, 20b or 20c by means of spherical joint 22c acting in swash plate race 24. The resulting force will cause swash plate 20, 20a, 20b or 20c to rotate in order to allow plunger 16c to move outward within cylinder 14c in order to provide expansion room within cylinder 14c for the fluid.

The resulting rotation of swash plate 20, 20a, 20b or 20c will be in a clockwise direction as viewed from the right side or end of device 10 as seen in FIG. 2. Swash plate 20, 20a, 20b or 20c will be forced to a position allowing plunger 16c to travel outward to its maximum extent within cylinder 14c, at which point it will appear as plunger 16a and cylinder 14a appear in FIG. 2 The simultaneous counterclockwise rotation of plunger gears 56a, b and c as they mesh with central gear 54 will casue relief 52c of plunger 16c to rotate within cylinder 14c to a position 90 degrees from either inlet port 38c or outlet port 40c at this point. (As noted in the above paragraph, it may be easier to visualize the foregoing at the upper cylinder and plunger 14a and 16a. The remainder of the operational description will be based from that point as the rotation and reciprocation of the plunger 16 would continue, so as to cause it to appear as shown at cylinder 14b in FIGS. 1 and 2.)

At this point, rotation of the plunger 16 continues so as to cause relief 52 to face outlet port 40, as shown in FIGS. 1 and 2 at cylinder 14b. The fluid, having accomplished the work described above, will be at a relatively low pressure and will leave device 10 by way of outlet manifold 46 and outlet manifold port 58. As in the case of device 10 being used as a pump or compressor as described above, cycles of the plural plunger and cylinder arrangement described above will overlap to produce a smoother output of torque, and rotational speed of shaft 28, with relatively little variation as compared to a single cylinder device.

Opposite rotation of device 10 when used as a motor is accomplished in the same manner as the reversal of inlet and outlet to reverse directional rotation of device 10 when used as a pump or compressor, as described above. The application of high pressure at the outlet manifold port 58 relative to the pressure at inlet manifold port 60, will cause device 10 to rotate in a direction opposite that described in the motor operational description above. Alternatively, it will be seen that the repositioning of plunger gears 56a, b and c and the resulting repositioning of plunger reliefs 52a, b and c at 180 degrees to the orientation described above and shown in the drawing figures, will also serve to cause the rotational direction of rotary shaft 28 to be reversed even though the pressure applied to inlet manifold port 60 is higher than that registered at oulet manifold port 58 as in the motor operational description above. This is due to the symmetry of the operational cycle and geometry of device 10 and will be seen to be similar to the discussion provided above for the reversal of rotational direction of device 10 when used as a pump or compressor.

Just as in the case of device 10 as pump or compressor, there may be a need to provide pressure relief in the event of pressures being developed or applied which are above those intended. Pressure relief valve 64 will of course operate in the same manner, whether device 10 is used as a pump, compressor or motor. The reversal of pressure relief valve 64 within passage 62 may be readily accomplished as described above, in the event that inlet flow I and outlet flow O are reversed in order to achieve a reversal of rotation for device 10.

From the foregoing, it will be seen that a fluid transfer device providing positive displacement of such fluid in the manner of the present invention, may be adapted for use as a pump, compressor or motor with no modification. Moreover, rotational direction is easily reversible in the present invention. The advantages provided by the inlet and outlet manifolds, one of which is contained completely within the boundaries of the other, along with the various other novel features disclosed herein, provide for a fluid transfer device with numerous advantages over the prior art.

It is to be understood that the present invention is not limited to the sole embodiment described above, but encompasses any and all embodiments within the scope of the following claims.

I claim:

1. A positive displacement fluid transfer device having a fluid inlet manifold, an annular fluid outlet manifold included wholly within the bounds of said fluid inlet manifold, and a rotary shaft, said inlet manifold, said outlet manifold, and said rotary shaft each having mutually parallel axes, said rotary shaft affixed to a swash plate having a surface with an inclined race formed therein, at least one plunger having a fitting adjacent one end with said fitting cooperating with said swash plate race, said plunger fitting comprising a generally spherical form, said swash plate race including a generally circular cross section with inner and outer lips extending therefrom and having internal dimensions closely cooperating with said plunger fitting, said race having a plunger fitting installation port cooperating with said race by means of an installation channel, at least one cylinder cooperating with said plunger, said cylinder having a major axis disposed parallel to said inlet manifold, said outlet manifold, and said rotary shaft axes and having inlet and outlet ports respectively cooperating with said inlet and said outlet manifolds, whereby said fluid is transferable by said device by means of said inlet and said outlet manifolds cooperating wich said cylinder by means of said inlet and outlet ports with said plunger cooperatingly reciprocating within said cylinder by means of said swash plate.

2. A positive displacement fluid transfer device for the transfer of a working fluid, said device having a working fluid inlet manifold, an annular working fluid outlet manifold included wholly within the bounds of said working fluid inlet manifold, and a rotary shaft, said inlet manifold, said outlet manifold, and said rotary shaft each having mutually parallel axes, said rotary shaft affixed to a single swash plate having a surface including a concave inclined race formed therein, at least one plunger having a fitting adjacent one end with said fitting captured by and positively cooperating with said swash plate race, at least one cylinder cooperating with said plunger, said cylinder having an end including sealing means precluding the escape of said working fluid from said cylinder end, said cylinder having a major axis disposed parallel to said inlet manifold, said outlet manifold and said rotary shaft axes, and having inlet and outlet ports respectively cooperating with said inlet and said outlet manifolds, whereby said working fluid is transferable by said device by means of said inlet and said outlet manifolds cooperating with said cylinder by means of said inlet and outlet ports with said plunger cooperatingly reciprocating within said cylinder by means of said plunger fittings captured by said swash plate concave inclined race.

3. The fluid transfer device of claim 2 wherein;

said inlet manifold, outlet manifold and rotary shaft are disposed about a common axis.

4. The fluid transfer device of claim 2 including;

a plurality of said cylinders and said cooperating plungers disposed in an annular array with each said cylinder major axis parallel to said inlet manifold, said outlet manifold and said rotary shaft axes.

5. The fluid transfer device of claim 2 including;

a central gear affixed to said rotary shaft and driving at least one plunger gear affixed to said plunger, said plunger gear intermeshed with said central gear, said plunger having a relief formed therein, whereby said plunger is caused to simultaneously reciprocate and rotate within said cylinder by means of said swash plate and said plunger gear to cause said plunger relief to periodically align with said inlet and said outlet ports to provide transfer of said fluid.

6. The fluid transfer device of claim 2 including;

at least one pressure relief passage radially disposed between said inlet manifold and completely enclosed and said outlet manifold, said pressure relief passage containing a pressure relief valve installed therein reaxially whereby any pressure exceeding a preset level may be bypassed directly from said outlet manifold to said inlet manifold by means of said radial pressure relief passage.

7. The fluid transfer device of claim 2 including;

utility passages radially disposed between said cylinder and said inlet manifold, said utility passages providing means for pressure relief, cooling and lubrication within said cylinder.

8. The fluid transfer device of claim 2 including;

means reversing the rotational direction of said rotary shaft comprising reversal of the direction of said transfer of said working fluid relative to said inlet and said outlet manifolds.

9. The fluid transfer device of claim 2 including;

means reversing the rotational direction of said rotary shaft comprising repositioning said plunger gears relative to said central gear.

10. The fluid transfer device of claim 2 including;

fixed means for positively capturing and retaining said plunger relative to said swash plate.

11. The fluid transfer device of claim 10 wherein;

said plunger fitting comprises a generally spherical form, said swash plate race includes a generally circular cross section with inner and outer lips extending therefrom and having internal dimensions closely cooperating with said plunger fitting, said race having a plunger fitting installation port cooperating with said race by means of an installation channel, whereby said plunger fitting is inserted within said installation port and passed to said race by means of said installation channel and captured within said race by means of said inner and outer lips.

12. The fluid transfer device of claim 10 wherein;

said plunger fitting comprises a generally spherical form, said swash plate comprises a single monolithic component, said swash plate race includes a generally circular cross section with a single inner lip extending therefrom and having internal dimensions closely cooperating with said plunger fitting, whereby said plunger fitting is retained within said race by means of said inner lip capturing said plunger fitting and said cylinder precluding transverse movement of said plunger.

13. The fluid transfer device of claim 10 wherein;

said plunger fitting comprises a generally spherical form and is disassembleable from said swash plate race, said swash plate race includes a generally circular cross section with a single outer lip extending therefrom and having internal dimensions closely cooperating with said plunger fitting, whereby said plunger fitting is retained within said race by means of said outer lip capturing said plunger fitting and said cylinder precluding transverse movement of said plunger.

* * * * *